US008857971B2

(12) United States Patent
Condello et al.

(10) Patent No.: US 8,857,971 B2
(45) Date of Patent: Oct. 14, 2014

(54) METHOD AN APPARATUS FOR LEVELING A PRINTED IMAGE

(75) Inventors: Anthony S. Condello, Webster, NY (US); Bryan Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 182 days.

(21) Appl. No.: 13/537,092

(22) Filed: Jun. 29, 2012

(65) Prior Publication Data

US 2014/0002557 A1 Jan. 2, 2014

(51) Int. Cl.
*B41J 2/01* (2006.01)

(52) U.S. Cl.
USPC ..... 347/102; 347/17; 347/19; 347/100; 347/101

(58) Field of Classification Search
CPC ..... B41J 2/01; B41J 11/002; B41J 11/0015; B41M 7/0072; C09D 11/101
See application file for complete search history.

(56) References Cited

U.S. PATENT DOCUMENTS

| | | | | |
|---|---|---|---|---|
| 7,325,916 | B2 * | 2/2008 | Baker et al. | 347/101 |
| 2005/0190248 | A1 * | 9/2005 | Konno et al. | 347/102 |
| 2006/0066704 | A1 * | 3/2006 | Nishida | 347/103 |
| 2008/0198189 | A1 * | 8/2008 | Vanhooydonck et al. | 347/9 |
| 2010/0220132 | A1 * | 9/2010 | Eldar et al. | 347/9 |
| 2010/0271449 | A1 * | 10/2010 | Kusunoki | 347/102 |
| 2011/0058000 | A1 * | 3/2011 | Rodin et al. | 347/102 |

* cited by examiner

*Primary Examiner* — Manish S Shah
*Assistant Examiner* — Jeremy Delozier
(74) *Attorney, Agent, or Firm* — Ronald E. Prass, Jr.; Prass LLP

(57) ABSTRACT

An approach is provided for curing an image applied to a substrate by way of a printing process. The approach involves causing, at least in part, one or more portions of the image to be cured to a predetermined degree to form one or more pinned portions. The approach also involves causing, at least in part, other portions of the image different from the pinned portions to reflow among the pinned portions to level the image. The approach further involves causing, at least in part, the reflowed portions of the image to be cured.

21 Claims, 6 Drawing Sheets

METHOD AN APPARATUS FOR LEVELING A PRINTED IMAGE

FIELD OF DISCLOSURE

The disclosure relates to a method and apparatus for leveling a printed image to prevent image defects in a finished print product.

BACKGROUND

Conventional printing processes often result in various image related defects such as lines that resemble a corduroy or vinyl record-like appearance. For example, one significant challenge associated with ultraviolet gel ink processes is that such corduroy-like image defects are an inherent byproduct of jetting ink onto a substrate to form an image while the substrate is moving on a media path.

SUMMARY

Therefore, there is a need for an approach for leveling a printed image to reduce or eliminate corduroy-like image defects.

According to one embodiment, a method comprises causing, at least in part, one or more portions of the image to be cured to a predetermined degree to form one or more pinned portions. The method also comprises causing, at least in part, other portions of the image different from the pinned portions to reflow among the pinned portions to level the image. The method further comprises causing, at least in part, the reflowed portions of the image to be cured.

According to another embodiment, an apparatus comprises at least one processor, and at least one memory including computer program code for one or more computer programs, the at least one memory and the computer program code configured to, with the at least one processor, cause, at least in part, the apparatus to cause, at least in part, one or more portions of the image to be cured to a predetermined degree to form one or more pinned portions. The apparatus is also caused to cause, at least in part, other portions of the image different from the pinned portions to reflow among the pinned portions to level the image. The apparatus is further caused to cause, at least in part, the reflowed portions of the image to be cured.

According to another embodiment, a computer-readable storage medium carries one or more sequences of one or more instructions which, when executed by one or more processors, cause, at least in part, an apparatus to cause, at least in part, one or more portions of the image to be cured to a predetermined degree to form one or more pinned portions. The apparatus is also caused to cause, at least in part, other portions of the image different from the pinned portions to reflow among the pinned portions to level the image. The apparatus is further caused to cause, at least in part, the reflowed portions of the image to be cured.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Figure 1:
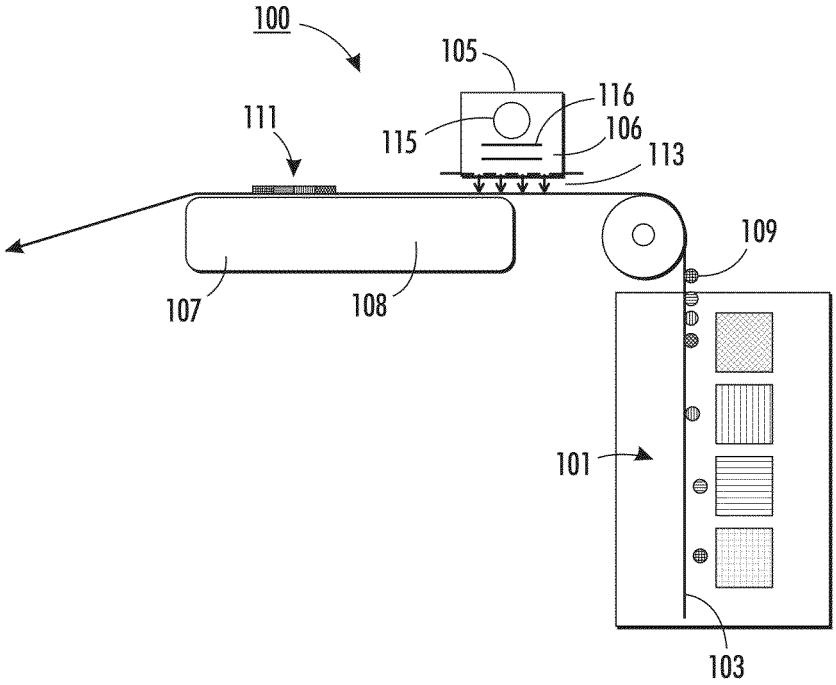
FIG. 1 is a diagram of a system capable of leveling a printed image to reduce or eliminate corduroy-like image defects, according to one embodiment.

Examples of a method, apparatus, and computer-readable medium for leveling a printed image to reduce or eliminate corduroy-like image defects are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "filter" refers to a medium through which light may be allowed to pass. For example, a filter may be configured to have transparent and non-transparent portions that allow light to shine through at least the transparent portions. Alternatively, the filter may be entirely transparent or entirely non-transparent.

As used herein, the term "transparent" refers to portions of a medium through which light is allowed to completely pass. Transparent portions may refer to portions of the medium that do not inhibit the passage of light, or portions that are absent in a body such as holes or openings through which light may be transmitted.

As used herein, the term "non-transparent" refers to portions of a medium that are not transparent. For example non-transparent may refer to translucency, partial transparency to a specific percentage, wavelength filtering, light refraction, complete opacity, and the like.

As used herein, the term "flash" refers to a brief or sudden burst of light shined briefly upon a subject during an exposure. For example, a flash may refer to a light being caused to blink at a frequency by activating and deactivating a light source that produces the light, or a shutter than causes the light to blink.

As used herein, the term "pinning" or any derivation thereof refers to causing an image to be set, cured or partially cured, finished, etc. to a certain degree at selected or predetermined portions of the image, but not all of the image entirely. For example, the pinned portions may correspond to a pinning pattern. A pinned portion of the image may refer to a portion that is set to a certain degree to maintain its position on a substrate throughout a print process to yield a desired print quality. The degree of pinning may refer to an amount that the pinned portion is set, cured, partially cured, etc. For example, a pinned portion may be completely cured so that it cannot be reflowed, or it may be partially cured so that it may reflow some, but less than, uncured portions of the image. The pinning degree may be caused, for example, by light source power selection, degree of transparency, degree of non-transparency, exposure time, substrate travel speed, or any combination thereof.

As used herein, the term "pinning pattern" refers to a layout of selected portions of an image that are to be pinned. The portions of the image that are selected may be portions offset such as according to a two dimensional pattern, or alternatively, or in addition to a two dimensional pattern, the pinning pattern may cause varying layers of an image to be pinned such that the pinning pattern is three dimensional. For example, if a light shined onto an image is caused to pin a yellow ink rather than other inks, only the yellow ink portions of an image would be pinned. The pinning pattern may be configured to cause any particular ink to be pinned, or alternatively, or in addition to such a layer of ink being pinned, it may refer to a certain coating that may be pinned.

FIG. 1 is a diagram of a system capable of leveling a printed image to reduce or eliminate corduroy-like image defects, according to one embodiment. Conventional printing processes often result in various image related defects such as lines that resemble a corduroy or vinyl record-like appearance. For example, one significant challenge associated with ultraviolet gel ink processes is that such corduroy-like image defects are an inherent byproduct of jetting ink onto a substrate to form an image while the substrate is moving on a media path.

One proposed solution to address this problem includes contact leveling such as mechanically applying a pressure by way of a roller or press pad, for example, to the substrate having the image. However, physically contacting the printed image often results in other image defects that are alternatively caused, or are in addition to, the corduroy-like image defects. Another proposed solution suggests reflowing any inks that are used to form the printed image after the image has been applied to the substrate. But, such reflowing often results in causing pin-hole-like defects to occur on the image.

To address this problem, a system 100 of FIG. 1 introduces the capability to level a printed image to reduce or eliminate corduroy-like image defects without causing additional defects and/or pin-hole-like defects, as discussed above. The system 100 provides a means for leveling a printed image without introducing additional image defects by pinning portions of the image to the substrate and then allowing other portions of the image that are not pinned to reflow and cure among the pinned portions. The pinning and allowed reflow effectively mitigates any corduroy-like defects while avoiding pin-hole-like defects. For example, as will be discussed in more detail below, the image may be pinned by the system 100 according to a predetermined pinning pattern.

According to various embodiments, the pinning of the image may be caused by curing, or partially curing, depending on a preference setting, one or more portions of the image after it has been printed onto a substrate. The pinned portions may be caused to cure to a desired degree by way of, for example, a pinning lamp that is configured to shine through a filter having both transparent and non-transparent regions. Accordingly, the image regions upon which light is allowed to shine are cured or partially cured, and therefore pinned. Regions of the image upon which light does not shine, because the light could not fully penetrate the filter, remain uncured, or cured an amount less than the pinned portions. Once the selective pinning is complete, the unpinned portions (i.e. the portions that are not selected for pinning) are allowed to reflow among the pinned portions. The reflow may occur as a function of time, or, to facilitate this reflow, heat may be applied to one or more of a backside or front side of the substrate. The reflow of the unpinned portions and/or any partially cured pinned portions results in leveling of the uncured and/or and partially cured ink that forms the image. Once leveled, the system 100 accordingly causes the image to be finally cured where the significantly leveled solid, having reduced or wholly eliminated corduroy-like image defects and no pin-hole-like defects, is made permanent.

As shown in FIG. 1, the system 100 comprises a print station 101 that applies an image to a substrate 103. The substrate 103 is shown as a webbed substrate having two surfaces upon which an image may be printed, but it should be noted that the substrate 103 may be any form such as a sheeted substrate, and have any number of sides. Additionally, the system 100 may have a belt that could be in place of, or in addition to, the webbed substrate 103, for example, to drive the webbed or sheeted substrate 103. The system 100 also comprises a pinning apparatus 105 to which the substrate 103 is advanced by the system 100 such that selected portions of the applied image are pinned by way of curing portions of the image a selected degree such as complete or partial curing. The pinning apparatus 105, according to various embodiments, may comprise a filter 106 that facilitates the selective curing. The system 100 further includes a reflow section 107. The reflow section 107 illustrated in FIG. 1 may be representative of a reflow region of the system 100 in which the unpinned portions of the image applied to the substrate 103 are allowed to reflow over a predetermined time. Alternatively, or in addition to simply being a reflow region, the reflow section 107 may have a heater element 108 that may apply heat to one or more sides of the substrate 103, and/or a belt that is part of the system 100.

According to various embodiments, the system 100 may be an inkjet printing system. For example, print station 101 may apply an image to the substrate 103 by jetting one or more ink droplets 109 onto the substrate 103. In one or more embodiments, the ink droplets 109 may be an ultraviolet gel thermal ink applied by an ultraviolet gel thermal jetting printing process. Though this example discusses examples directed to inkjet printing, any method of printing may be applicable in which leveling of the image may be beneficial to improve image quality and/or to avoid defects such as the corduroy effect discussed above. The ink droplets 109 that form the image may be selectively cured to a selected degree by the pinning apparatus 105 such that portions of the image are pinned to the substrate, and other portions are allowed to reflow at the reflow section 107, regardless of whether the reflow is simply allowed to occur over time, or if it is facilitated by heating the substrate 103 and/or a belt.

The reflow of the ink droplets 109 that are unpinned (i.e. uncured) and/or partially cured by the pinning apparatus 105 causes the image to be leveled among the pinned ink droplets resulting in a leveled image 111 that may be caused to finally cure by the system 100 to finalize the image applied to the substrate 103.

According to various embodiments, the pinning apparatus 105 may take many forms. For example, the selected portions of the image may be cured by shining a light 113 onto portions of the image. The light 113 may be supplied, for example, by any ultraviolet or LED light source 115. Any light 113 that is shined onto the substrate 103 may be direct or indirect. For example, the light 113 may travel directly from the light source 115 to the substrate 103, or it may be reflected by any number of reflective surfaces that are part of the pinning apparatus 105. The light 113 that is shined onto the substrate 103 by the pinning apparatus 105 is shined through the filter 106 that allows light to shine onto the selected portions of the image to pin those portions by curing or at least partially curing them. For example, the filter 106 may have transparent and non-transparent portions such that the portions of the image that are cured have light 113 shined on them through the filter 106 by way of the transparent portions. Light 113 produced by the light source 115 that may pass through the non-transparent portions of the filter 106 may partially cure, or not cure, any ink droplets 109 upon which light 113 might shine. For example, if the non-transparent portions are portions such that they are translucent, for example, and/or allow a certain percentage of light to pass through them such as, but not limited to 50%. Or, for example, the non-transparent portions may be configured to be wavelength filter to filter, for example, ultraviolet light, or other specific wavelength ranges. Or, if the non-transparent portions are completely opaque, the light 113 will not be transmitted onto the substrate 103 thereby not curing any of the portions of the image upon which light 113 does not shine.

According to various embodiments, the light source 115 may be configured to flash, actuate on demand, or remain constant. If the light source 115 flashes, the flash may be at a predetermined frequency that may or may not be tied to a moving speed of the substrate 103 or a belt, for example. The light source 115 may itself flash, or it may be caused to flash the light 113 by way of a shutter 116, for example. If actuated on demand, the light source 115 may, for example, turn on at a lead edge of an image applied to the substrate 103 or a sheeted substrate 103, and turn off at a trailing edge of the image or a sheeted substrate 103. Alternatively, or in addition to turning on and off on demand, the light 113, may be allowed or not allowed to shine onto the substrate 103 by actuating the shutter 116, as discussed above.

In one or more embodiments, the pinning apparatus 105 may have a filter 106 that is fixed, movable, comprises one or more plates, comprises one or more screens, comprises one or more belts, comprises one or more rollers, or any combination thereof. As discussed above, in one or more embodiments, a substrate 103 maybe advanced to and beyond the pinning apparatus 105 for pinning selected portions of the image to the substrate 103. The pinning may occur while the substrate 103 is moving past the pinning apparatus 105, or when the substrate 103 is momentarily stationary at the pinning apparatus 105.

If the substrate 103 is moved past a position at which the light 113 is shined onto the image at a predetermined speed in a process direction, the filter 106, accordingly, may be movable and configured to advance in the process direction at the same speed while the substrate 103 is advanced past the position at which the light 113 is shined onto the image. Such movement of the filter enables curing such that any streaked curing may be prevented. For example, if the filter 106 does not move with the substrate 103 at the same speed, effective pinning may not occur, and selected portions may effectively streak while being cured. Accordingly, to facilitate this movement, the filter 106 may be configured to move at a same speed as the substrate 103. Or, the filter 106 may move at any predetermined speed to facilitate curing or partially curing of the selected portions of the image applied to the substrate 103 if causing a streak is desired.

Alternatively, the filter 106 may be fixed so that it does not move when the substrate is advanced past the light source 115. To avoid streaking, the substrate 103 may momentarily pause when the substrate 103 is aligned with the filter 106, or the light 113 may be selectively shined to avoid streaking. For example, if the substrate is continually advanced past the position at which the light 113 is shined onto the image at a predetermined speed in a process direction, the light 113 may be caused to flash at least once while the substrate 103 is advanced past the position at which the light 113 is shined onto the image in the process direction. In one or more embodiments, the flashing may be timed such that the light 113 flashes at a frequency coordinated with the predetermined speed. So, the timing of the flashing of the light 113 may cause one or more portions of the image to be cured while the substrate 103 is advanced past the position at which the light 113 is shined onto the image. As the substrate 103 advances and the one or more portions to be cured align with corresponding portions of the filter downstream in the process direction, the light 113 may flash to cure only those portions that are to be cured at times when they align with the transparent portions of the filter 106.

As discussed above, the filter 106 has transparent and non-transparent regions to form a pinning pattern. In one embodiment, the transparent and non-transparent regions are evenly spaced. In alternative embodiments, the transparent and non-transparent regions may be randomly spaced so that they are not evenly spaced. Either form of spacing may be facilitated for example by the pinning pattern being a dot matrix. The dot matrix may take any form. For example, the pinning pattern may be formed by applying non-transparent regions the transparent material such as by jetting ink onto a transparent substrate at a resolution pattern at least at the same level as the image on the substrate, or at any resolution. Or, for example, the pinning pattern may be formed by applying stickers, or some other non-transparent material to a transparent material. Alternatively, or in addition to applying the non-transparent regions to a transparent material, the filter 106 may comprise a non-transparent material having one or more holes that form the transparent regions. According to various embodiments, the filter 106 may comprise any number of combinations of these examples such as, for example, multiple layers of varying types of filters that may be caused to align on demand to having various desirable pinning effects.

According to various embodiments, the pinning pattern may resemble a screen, for example, and the pinning pattern may be formed by one or more crossing lines. Alternatively, or in addition to being formed by one or more crossing lines, the pinning pattern may be formed, as discussed above, as a dot matrix. The dots may take any shape such as circles, ellipses, triangles, squares, rectangles, any other polygon or shape, etc. for example. The pinning pattern may also be any form that creates channels between cured regions, for example, as well.

In one or more embodiments, the non-transparent regions may be spaced evenly or unevenly by one or more distances in the range of 1 to 5000 μm. In other embodiments, the non-transparent regions may be spaced evenly or unevenly by one or more distances in the range of 10 to 1000 μm.

Figure 2:
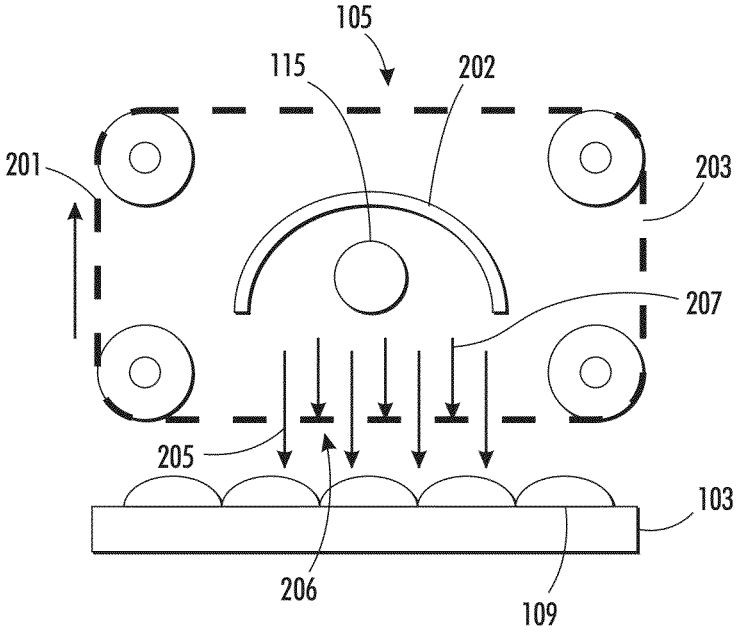
FIG. 2 is a diagram of a pinning apparatus having a belt light filter, according to one embodiment.

FIG. 2 is a diagram of a pinning apparatus 105 that is a belt-type pinning apparatus. The filter 106 discussed above comprises a belt. Accordingly, the pinning apparatus 105, in this example, comprises a light source 115 that shines light through one or more belt-filters 201. According to various embodiments, the belt-filter 201 is configured to move at a same speed as the substrate 103 so that when the substrate 103 advances through the print system 100, the transparent regions of the belt-filter 201 remain aligned with corresponding portions of the image on the substrate 103 to cause those portions of the image to cure to the selected degree without streaking.

For example, the light source 115 shines light directly onto the substrate 103, or indirectly as reflected by reflecting surface 202, in a direction of the substrate 103. The belt-filter 201, as discussed above, has transparent portions 203 and non-transparent portions 206. The belt-filter 201 allows light 205 to pass through it onto the image formed by ink droplets 109, discussed above. The portions of the image, i.e. ink droplets 109 that are aligned with the transparent portions 203 of the belt-filter 201 and have light 205 shined onto them, are accordingly cured either wholly or partially. As the substrate 103 moves past the a position at which the light source 115 shines light onto the substrate 103, the belt-filter 201 moves at the same speed so that light 205 is continually shined on the ink droplets 109 that are to be cured. The belt-filter 201, as discussed above, has non-transparent portions 206 that block light produced by the light source 115 such that light 207 is completely blocked if the non-transparent portions 206 are opaque, for example. Or, if the non-transparent portions 206 are translucent, which allows some light to pass, the portions of the image upon which any light passing through the non-transparent portions 206 may be cured less than the portions of the image that light 205 shines on the image, or not at all.

In one or more embodiments, the belt filter 201 may be stationary, whether intentionally or in the case of a malfunction of the belt filter 201. If stationary, or if a malfunction is determined, the light produced by the light source 115 may be caused to actuate on demand or flash at a determined frequency, as discussed above.

Figure 3:
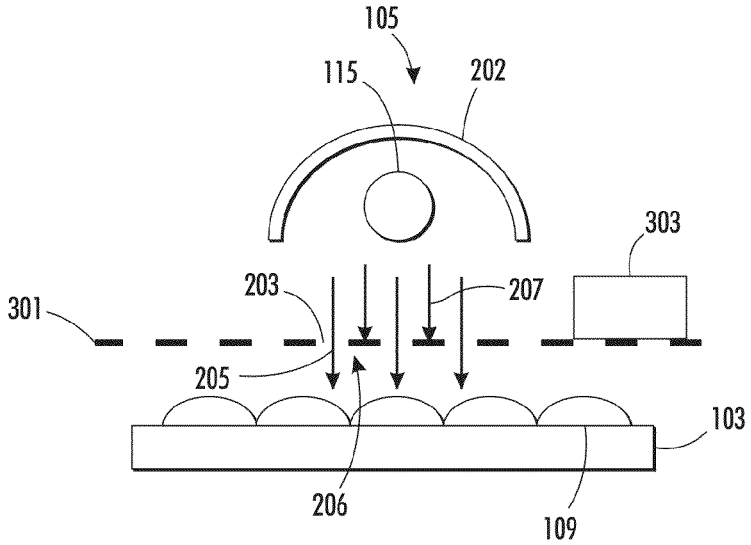
FIG. 3 is a diagram of a pinning apparatus having a plate light filter, according to one embodiment.

FIG. 3 is a diagram of a pinning apparatus 105 that is a plate-type pinning apparatus. The filter 106 discussed above comprises a plate. Accordingly, the pinning apparatus 105, in this example, comprises a light source 115 that shines light through one or more plate-filters 301. The plate-filter 301, though illustrated as being generally flat, may take any shape, whether it be flat, rounded, wavy, angular, symmetric with respect to itself, etc. Additionally, the plate-filter 301 may be positioned parallel to the substrate, or any other position that may be askew, for example.

In one or more embodiments, the plate-filter 301 may be stationary or fixed, as discussed above. For example, the plate-filter 301 may be caused to move by a motor 303 at a same speed as the substrate 103 so that when the substrate 103 advances through the print system 100, the transparent regions of the plate-filter 301 remain aligned with corresponding portions of the image on the substrate 103 to cause those portions of the image to cure to the selected degree. For example, the light source 115 shines light directly to onto the substrate 103, or indirectly as reflected by reflecting surface 202, in a direction of the substrate 103. The plate-filter 301, as discussed above, has transparent portions 203 and non-transparent portions 206. The plate-filter 301 allows light 205 to pass through it onto the image formed by ink droplets 109 discussed above. The portions of the image, i.e. ink droplets 109 that are aligned with the transparent portions 203 of the plate-filter 301 and have light 205 shined onto them, are accordingly cured. As the substrate 103 moves past the a position at which the light source 115 shines light onto the substrate 103, the plate-filter 301 moves at the same speed so that light 205 is shined on the ink droplets 109 that are to be cured. The plate-filter 301 may then be caused to retract, for example, for the next image that is set to pass the curing light 205. The plate-filter 301, as discussed above, has non-transparent portions 206 that block light produced by the light source 115 such that light 207 is completely blocked if the non-transparent portions 206 are opaque, for example. Or, if the non-transparent portions 206 are translucent, which allows some light to pass, the portions of the image upon which any light passing through the non-transparent portions 206 may be cured less than the portions of the image that light 205 shines on the image, or not at all.

As discussed above, plate-filter 301 may be stationary, whether intentionally or in the case of a malfunction of the motor 303, for example. If stationary, or if a malfunction is determined, the light produced by the light source 115 may be caused to actuate on demand or flash at a determined frequency, as discussed above.

Figure 4:
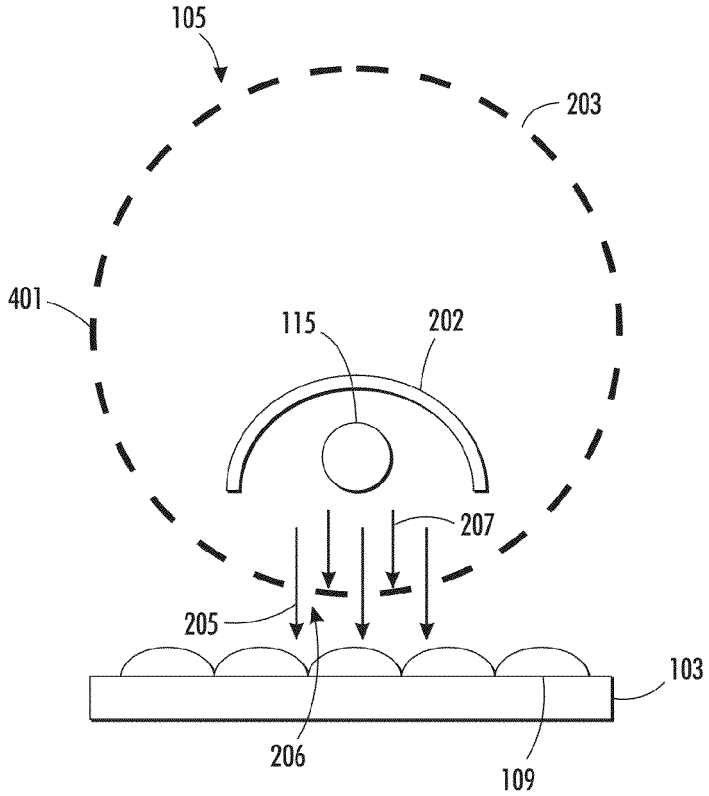
FIG. 4 is a diagram is a diagram of a pinning apparatus having a roller light filter, according to one embodiment.

FIG. 4 is a diagram of a pinning apparatus 105 that is a roller-type pinning apparatus. The filter 106 discussed above comprises a roller. Accordingly, the pinning apparatus 105, in this example, comprises a light source 115 that shines light through one or more roller-filters 401. According to various embodiments, the roller-filter 401 is configured to rotate at a same speed as the substrate 103, or at a speed that causes light to shine on the selected portions of the image, so that when the substrate 103 advances through the print system 100, the transparent regions of the roller-filter 401 remain aligned with corresponding portions of the image on the substrate 103 to cause those portions of the image to cure to the selected degree.

For example, the light source 115 shines light directly to onto the substrate 103, or indirectly as reflected by reflecting surface 202, in a direction of the substrate 103. The roller-filter 401, as discussed above, has transparent portions 203 and non-transparent portions 206. The roller-filter 401 allows light 205 to pass through it onto the image formed by ink droplets 109. The portions of the image, i.e. ink droplets 100 that are aligned with the transparent portions 203 of the roller-filter 401 and have light 205 shined onto them, are accordingly cured. As the substrate 103 moves past the position at which the light source 115 shines light onto the substrate 103, the roller-filter 401 rotates about a central axis at the same speed, or a speed that effectively aligns the transparent portions 203 with the portions of the image to be cured, so that light 205 is shined on the ink droplets 109 that are to be cured. The roller-filter 401, as discussed above, has non-transparent portions 206 that block light produced by the light source 115 such that light 207 is completely blocked if the non-transparent portions 206 are opaque, for example. Or, if the non-transparent portions 206 are translucent, which allows some light to pass, the portions of the image upon which any light passing through the non-transparent portions 206 may be cured less than the portions of the image that light 205 shines on the image, or not at all.

In one or more embodiments, the roller filter 401 may be stationary, whether intentionally or in the case of a malfunction of the roller filter 401. If stationary, or if a malfunction is determined, the light produced by the light source 115 may be caused to actuate on demand or flash at a determined frequency as discussed above.

It should be noted that while the embodiments described in FIGS. 2-4 are discussed exclusively, this is done merely to simplify the examples. Any pinning apparatus 105 may be configured to have any combination of types of filters such as belt-filter 201, plate-filter 301 and roller-filter 401, for example. Additionally, the light 113 discussed above produced by the light source 115 may be constant, actuated on demand, or flashed on demand or at a predetermined frequency regardless of whether the filter is caused to move or if the filter is fixed.

Figure 5:
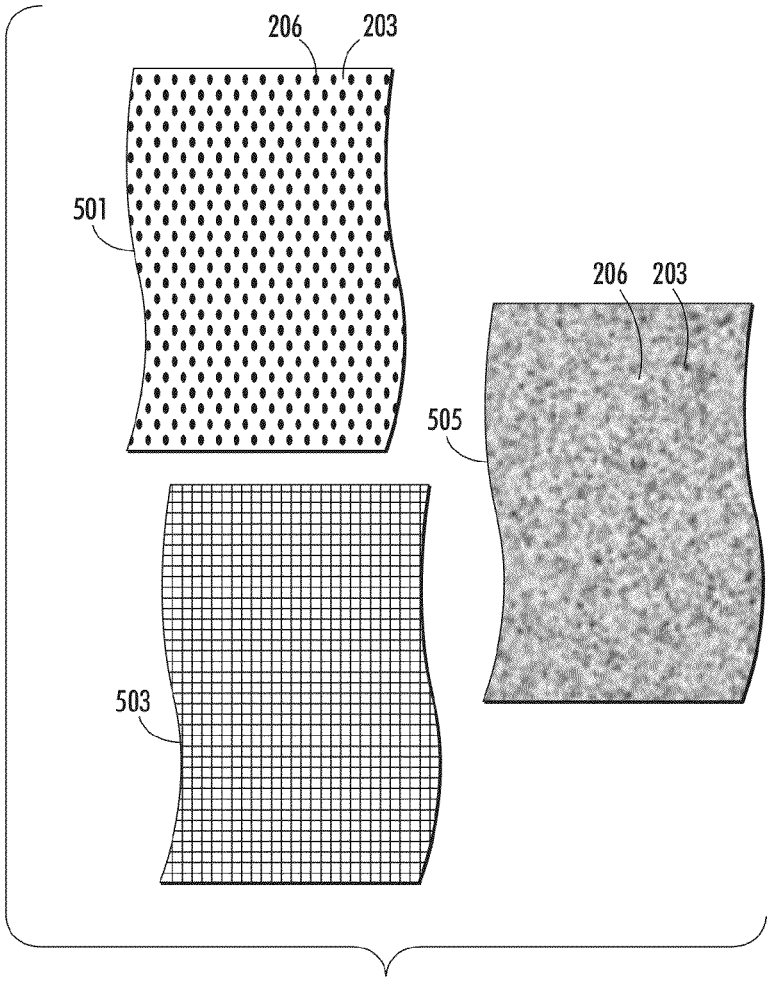
FIG. 5 is a diagram of example pinning pattern configurations, according to various embodiments.

FIG. 5 is an illustration of example embodiments of a surface of a filter 106 discussed above that forms a pinning pattern. As discussed above, the filter 106 may have a dot matrix type 501 and/or a crossed-line-type 503 pinning pattern. Alternatively, the filter 106 may be a non-uniform type such as pattern 505. Regardless of type, as discussed above, the filter 106 has transparent and non-transparent regions 203, 206 to form the pinning pattern. In one embodiment, the transparent and non-transparent regions 203, 206 may be evenly spaced. In alternative embodiments, the transparent and non-transparent regions 203, 206 may be randomly spaced such as that shown in pattern 505 so that they are not evenly spaced.

Either form of spacing may be facilitated if, for example, the pinning pattern is a dot matrix. The dot matrix may take any form. For example, the pinning pattern may be formed by applying non-transparent regions 206 to a transparent material such as by jetting ink onto a transparent substrate at a resolution pattern at least at the same level as the image on the substrate 103, or at any resolution. Or, for example, the pinning pattern may be formed by applying stickers, or some other non-transparent form to the transparent substrate. Alternatively, or in addition to applying the non-transparent regions 206, the filter 106 may comprise a non-transparent material having one or more holes to form the transparent regions 203. Or, the pinning pattern may simply be an entirely non-transparent pattern which may be illustrated by pattern 505, for example, in which there are varying non-transparent degrees that form the pinning pattern such that some portions of the image may be partially cured more or less than other portions of the image. For example, some non-transparent portions 206 may allow 80% of light to pass, while others are opaque and allow no light to pass, while others allow 40% of light to pass. Such varying degrees of non-transparency would affect how much a portion of the image is allowed to cure when light is exposed through those varying portions of the filter 106. Alternatively, or in addition to varying transparent and non-transparent patterns and degrees of non-transparency, some non-transparent portions may be configured to filter particular wavelengths of light to allow pinning of certain layers of the inked image, for example, or any curing that corresponds with a particular coating to cure a sub-portion of the image.

According to various embodiments, the pinning pattern may be a screen such as that illustrated as crossed-line-type pinning pattern 503, for example, and the pinning pattern may be formed by one or more crossing lines. Alternatively, or in addition to being formed by one or more crossing lines, the pinning pattern may be formed, as discussed above, as a dot matrix. The dots may take any shape such as circles, ellipses, triangles, squares, rectangles, any other polygon or shape, for example. The pinning pattern may also be any form that creates channels between cured regions, for example, or a non-woven fibrous porous mesh as well.

In one or more embodiments, the non-transparent regions 206 may be spaced evenly or unevenly by one or more distances in the range of 1 to 5000 μm. In other embodiments, the non-transparent regions 206 may be spaced evenly or unevenly by one or more distances in the range of 10 to 1000 μm.

Figure 6:
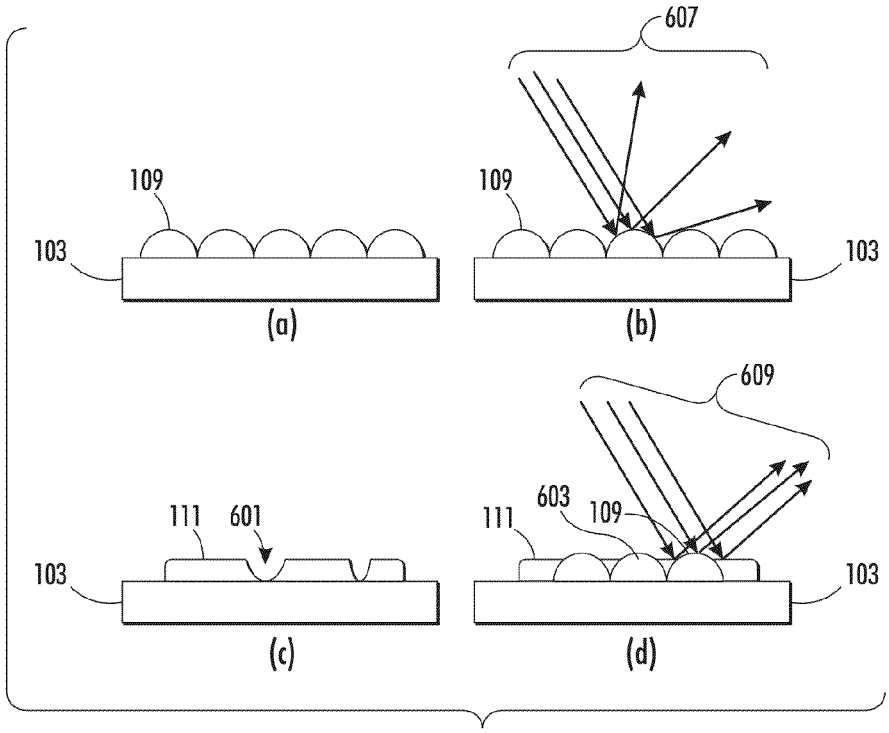
FIG. 6 is a series of diagrams illustrating image defects and the effects the disclosed apparatus and method has on a printed image, according to one embodiment.

FIG. 6 illustrates a comparison of what may happen to an image applied to substrate 103 as a result of various printing/curing operations. For example, diagram (a) illustrates a substrate 103 having an image formed by ink droplets 109. Diagram (a) shows an image that has not been pinned such as by a pinning apparatus 105 discussed above and has not been allowed to reflow. The resulting image has peaks and valleys that form a corduroy appearance because ink droplets 109 are cured in their initial, un-altered form which may be the same as their applied form, depending on a type of ink used to form the image.

Diagram (b) illustrates a substrate 103 having an image formed by ink droplets 109. Diagram (b) shows an image that has been entirely pinned (in other words cured) and then allowed to reflow. Because all of the ink droplets 109 have been completely cured, they cannot be caused to reflow, and accordingly maintain their cured positioning. The cured positioning results in an image that has peaks and valleys that form a corduroy appearance because ink droplets 109 are cured in their initial un-altered form, which may be their initial applied form depending on a type of ink used to form the image. Reflected light 607 illustrates the effects that the corduroy-like image defects may cause and exaggerate any instances of having a non-uniform gloss or finish. In other words, light 607 reflects non-uniformly and bounces off the ink droplets 109 in different directions which is apparent to a viewer of the image formed by ink droplets 109, and may be deemed defective.

Diagram (c) illustrates an image formed by ink droplets 109 discussed above that have not been pinned and are allowed to reflow before curing the image. Allowing the ink droplets 109 to reflow without pinning causes a leveled image 111 to form, but, without pinning, there are gaps known as pin-holes illustrated as pin-holes 601 that form in the leveled image.

Diagram (d) illustrates an image formed by ink droplets 109 discussed above that have been selectively pinned by curing using a pinning apparatus 105 discussed above. The selected ink droplets 109, when cured, form pinned portions 603 that remain in their cured position when reflow occurs for any uncured ink droplets. Allowing the uncured ink droplets to reflow facilitates a leveling of the image formed by the ink droplets 109 on the substrate 103 by enabling the uncured portions of the image to fill in the gaps between the pinned portions 603. By having the pinned portions 603 as anchors, a sufficiently leveled image 111 is formed without any pin-hole defects 601 such as those illustrated in diagram (c).

Reflected light 609 illustrates the effects that the leveled image 111 may have on reflected light. The image 111 has a uniform, or nearly uniform, gloss or finish. In other words, light 609 reflects uniformly and bounces off the leveled image in as closed to the same direction as possible. Such uniform reflection of light indicates a quality finished image when observed by a viewer.

Figure 7:
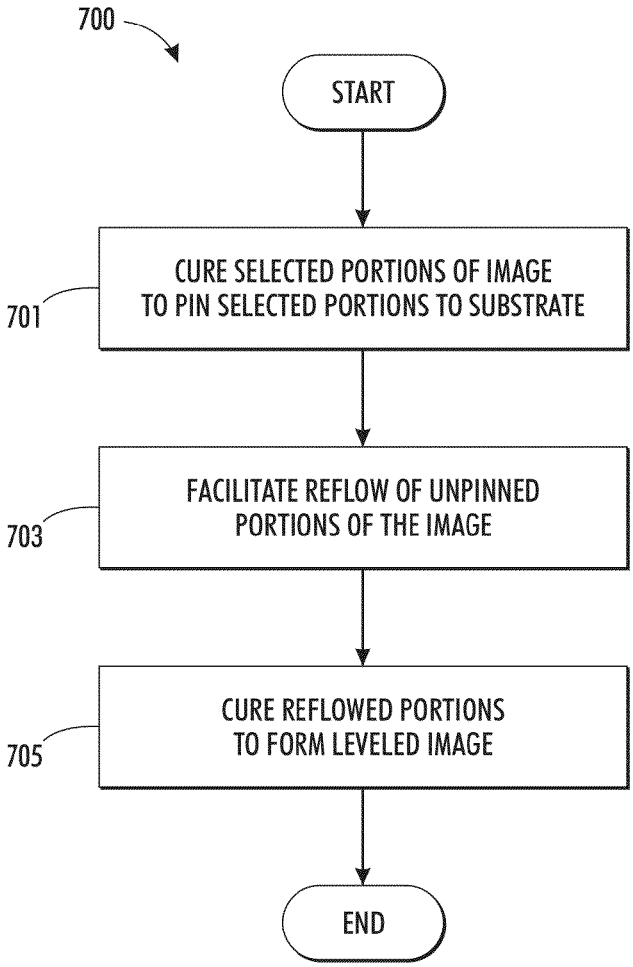
FIG. 7 is a flowchart of a method of leveling a printed image to reduce or eliminate corduroy-like image defects, according to one embodiment
Figure 8:
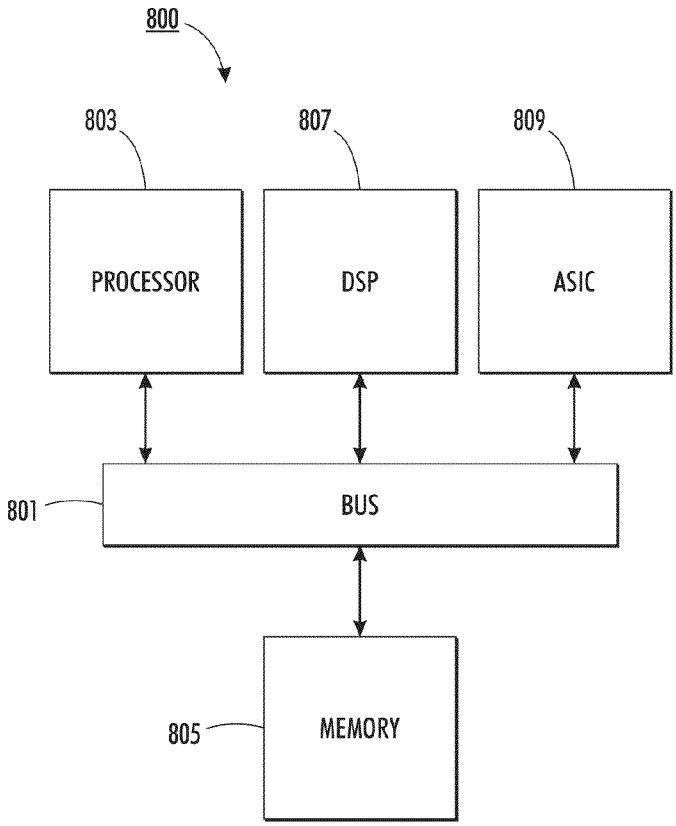
FIG. 8 is a diagram of a chip set that can be used to implement an embodiment.

FIG. 7 is a flowchart of a process for leveling a printed image to reduce or eliminate corduroy-like image defects, according to one embodiment. In one embodiment, a processor may perform the process 700 and is implemented in, for instance, a chip set including a processor and a memory as shown in FIG. 8. In step 701, one or more portions of an image applied to a the substrate 103 discussed above by way of applying ink droplets 109 to a surface of the substrate 103 are cured to a predetermined degree to form one or more pinned portions 603 discussed above. The pinned portions 603, as discussed above, may act as anchors during a reflow process that levels the image applied to the substrate 103. In one or more embodiments, the pinned portions 603 may be caused by light 113, discussed above, that is shined onto the image through filter 106 to form the one or more pinned portions 603. The filter 106, in some embodiments, may be movable or fixed. If movable, the substrate 103 may be caused to advance past a position at which the light 113 is shined onto the image at a predetermined speed in a process direction. Because the filter 106 is movable, the filter 106 may also be caused to advance in the process direction at the predetermined speed while the substrate is advanced past the position at which the light is shined onto the image. In addition, or alternatively if the filter 106 is fixed, the light 113 may be caused to flash at least once while the substrate 103 is advanced past the position at which the light 113 is shined onto the image in the process direction. In one or more embodiments, the light 113 may be caused to flash at a frequency coordinated with the predetermined speed to cause, at least in part, the one or more portions of the image to be cured to form the pinned portions 603 while the substrate 103 is advanced past the position at which the light 113 is shined onto the image and the one or more portions to be cured to form the pinned portions 603 align with corresponding portions of the filter 106 downstream in the process direction.

According to various embodiments, to facilitate the pinning, the advancement of the substrate 103 may be caused to pause at a time the image is aligned with the filter, and the light 113 may be caused to flash at least once at the time the image is aligned with the filter 106. As discussed above, the light 113 may be caused to flash by way of one or more of actuating the light source 115 on demand, actuating the light source 115 at a predetermined frequency or by opening and closing one or more shutters 116. The light source 115, as discussed above, in one or more embodiments may be any of an ultraviolet light source and an LED.

As discussed above, to facilitate the pinning, the filter 106 has transparent and non-transparent regions 203, 206 to form a pinning pattern 501, 503. In one or more embodiments, the transparent and non-transparent regions 203, 206 may be evenly spaced. Alternatively, they may be unevenly spaced. The pinning pattern 501, 503, according to some embodiments may be any of a dot matrix and/or a series of crossed lines. According to various embodiments, the non-transparent regions 206 may be spaced by one or more distances in the range of 1 to 5000 μm. In other embodiments, the non-transparent regions 206 may be spaced by one or more distances in the range of 10 to 1000 μm. In one or more embodiments, the filter 106 comprises a transparent material and the non-transparent regions 206 are applied to the transparent material. Alternatively, or in addition to the filter 106 being a transparent material having applied non-transparent regions 206, the filter 106 may comprise a non-transparent material having one or more holes to form the transparent regions 203. As discussed above, the non-transparent regions 206 may be any of opaque and/or translucent, for example.

The process continues to step 703 in which the other portions of the image different from the pinned portions 603 are caused to reflow among the pinned portions 603 to level the image. According to various embodiments, the reflow may be facilitated by one or more of allowing the other portions of the image different from the pinned portions 603 to migrate over a predetermined period of time, or causing, at least in part, at least a portion of the substrate 103 upon which the image is applied to be heated to facilitate the reflow. Then, in step 705, the reflowed portions of the image are caused to be cured.

The processes described herein for leveling a printed image to reduce or eliminate corduroy-like image defects may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 8 illustrates a chip set or chip 800 upon which an embodiment may be implemented. Chip set 800 is programmed to facilitate leveling a printed image to reduce or eliminate corduroy-like image defects as described herein may include, for example, bus 801, processor 803, memory 805, DSP 807 and ASIC 809 components.

The processor 803 and memory 805 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 800 can be implemented in a single chip. It is further contemplated that in certain embodiments the chip set or chip 800 can be implemented as a single "system on a chip." It is further contemplated that in certain embodiments a separate ASIC would not be used, for example, and that all relevant functions as disclosed herein would be performed by a processor or processors. Chip set or chip 800, or a portion thereof, constitutes a means for performing one or more steps of leveling a printed image to reduce or eliminate corduroy-like image defects.

In one or more embodiments, the chip set or chip 800 includes a communication mechanism such as bus 801 for passing information among the components of the chip set 800. Processor 803 has connectivity to the bus 801 to execute instructions and process information stored in, for example, a memory 805. The processor 803 may include one or more processing cores with each core configured to perform independently. A multi-core processor enables multiprocessing within a single physical package. Examples of a multi-core processor include two, four, eight, or greater numbers of processing cores. Alternatively or in addition, the processor 803 may include one or more microprocessors configured in tandem via the bus 801 to enable independent execution of instructions, pipelining, and multithreading. The processor 803 may also be accompanied with one or more specialized components to perform certain processing functions and tasks such as one or more digital signal processors (DSP) 807, or one or more application-specific integrated circuits (ASIC) 809. A DSP 807 typically is configured to process real-world signals (e.g., sound) in real time independently of the processor 803. Similarly, an ASIC 809 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 803 performs a set of operations on information as specified by computer program code related to leveling a printed image to reduce or eliminate corduroy-like image defects. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 801 and placing information on the bus 801. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 803, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 803 and accompanying components have connectivity to the memory 805 via the bus 801. The memory 805 may include one or more of dynamic memory (e.g., RAM, magnetic disk, writable optical disk, etc.) and static memory (e.g., ROM, CD-ROM, etc.) for storing executable instructions that when executed perform the inventive steps described herein to facilitate leveling a printed image to reduce or eliminate corduroy-like image defects. The memory 805 also stores the data associated with or generated by the execution of the inventive steps.

In one or more embodiments, the memory 805, such as a random access memory (RAM) or any other dynamic storage device, stores information including processor instructions for leveling a printed image to reduce or eliminate corduroy-like image defects. Dynamic memory allows information stored therein to be changed by system 100. RAM allows a unit of information stored at a location called a memory address to be stored and retrieved independently of information at neighboring addresses. The memory 805 is also used by the processor 803 to store temporary values during execution of processor instructions. The memory 805 may also be a read only memory (ROM) or any other static storage device coupled to the bus 801 for storing static information, including instructions, that is not changed by the system 100. Some memory is composed of volatile storage that loses the information stored thereon when power is lost. The memory 805 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 803, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for curing a multi-ink image applied to a substrate comprising:

applying a multi-ink image to a substrate with a print station;

curing one or more discrete portions of the applied multi-ink image on the substrate to a predetermined degree to form one or more discrete pinned portions of the multi-ink image on the substrate;

applying heat to the substrate with a heater element to cause non-pinned portions of the applied multi-ink image to reflow around the pinned portions to level the applied multi-ink image on the substrate between the pinned portions and the non-pinned portions; and separately curing the non-pinned portions of the applied multi-ink image.

2. The method of claim 1, the curing the one or more discrete portions of the applied multi-ink image on the substrate comprising shining a light onto the multi-ink image on the substrate through a filter component including a plurality of opaque portions separating a plurality of transparent portions to form the one or more discrete pinned portions of the applied multi-ink image on the substrate.

3. The method of claim 2, further comprising advancing the substrate with the multi-ink image formed thereon past a position at which the light is shined onto the multi-ink image at a predetermined speed in a process direction, the filter component being advanced in the process direction at the same predetermined speed in order that the plurality of transparent portions of the filter component remain aligned with the one or more discrete pinned portions.

4. The method of claim 3, wherein the filter component is at least one of a belt and a roller that is configured to physically surround the light and to be advanced in the process direction about the light.

5. The method of claim 2, further comprising:

advancing the substrate with the multi-ink image formed thereon past a position at which the light is shined onto the multi-ink image at a predetermined speed in a process direction; and flashing the light through the filter component at a frequency that is coordinated with the predetermined speed that the substrate is advanced past the position at which the light is shined onto the multi-ink image in the process direction to incrementally cure the one or more discrete pinned portions as the one or more discrete pinned portions are sequentially aligned with the plurality of transparent portions of the filter component.

6. The method of claim 5, further comprising:

pausing the advancing of the substrate with the multi-ink image formed thereon in the process direction at a position at which the one or more discrete pinned portions of the multi-ink image are aligned with the plurality of transparent portions of the filter component; and adjusting the frequency of the flashing of the light through the filter component to correspond to a timing of the pausing the advancing of the substrate that aligns the one or more discrete pinned portions of the multi-ink image with the plurality of transparent portions of the filter component.

7. The method of claim 2, the plurality of transparent portions and the plurality of opaque portions of the filter component forming a pinning pattern, the pinning pattern being comprised on one of a dot matrix pattern or a crossing lines pattern.

8. The method of claim 7, the filter component being formed of a transparent material with a non-transparent material being applied to the transparent material to form the plurality of opaque portions.

9. The method of claim 7, the filter component being formed of a non-transparent material with holes punched therein to form the plurality of transparent portions.

10. The method of claim 1, the multi-ink image being applied to the substrate using an ultraviolet gel thermal ink jetting printing process.

11. An apparatus for curing a printed multi-ink image applied to a substrate comprising:

a print station that applies a multi-ink image on a substrate;

a light source that is positioned downstream of the print station in a process direction and is configured to apply curing radiation to the multi-ink image deposited on the substrate;

a moving device on which the substrate is placed to advance the substrate in the process direction;

a filter component that is interposed between the light source and the substrate, the filter component including a plurality of opaque portions separating a plurality of transparent portions such that the light source applies the curing radiation through the oplurality of transparent portions to cure one or more discrete portions of the multi-ink image on the substrate; and a processor that is programmed to:

operate the light source in conjunction with the filter component to cure the one or more discrete portions of the multi-ink image to a predetermined degree to form one or more discrete pinned portions, the light being shined through the plurality of transparent portions of the filter component to form the one or more discrete pinned portions; and operate a heat source to separately cause non-pinned portions of the multi-ink image to reflow around the around the one or more discrete pinned portions to level the applied multi-ink image on the substrate between the one or more discrete pinned portions.

12. The apparatus of claim 11, the moving device advancing the substrate with the multi-ink image formed thereon past a position at which the light is shined through the filter component onto the applied multi-ink image at a predetermined speed in the process direction, the filter component being moved with respect to the light source to advance the plurality of transparent portions of the filter component in the process direction at the predetermined speed while the substrate is advanced past the position at which the light is shined onto the multi-ink image to maintain an alignment between the plurality of transparent portions of the filter component with the one or more discrete pinned portions of the multi-ink image on the substrate.

13. The apparatus of claim 12, the filter component being one of a belt and a roller disposed around the light source and configured to be advanced in the process direction about the light source.

14. The apparatus of claim 11, the moving device advancing the substrate with the multi-ink image formed thereon past the position at which the light is shined through the filter component onto the applied multi-ink image at the predetermined speed in the process direction, and the processor is further programmed to flash the light source through the filter component at a frequency that is coordinated with the predetermined speed that the substrate is advanced past the position at which the light is shined onto the applied multi-ink image in the process direction to incrementally cure the one or more discrete pinned portions as the one or more discrete pinned portions are sequentially aligned with the plurality of transparent portions of the filter component.

15. The apparatus of claim 14, the filter component being fixed with respect to the light source.

16. The apparatus of claim 15, wherein the processor is further programmed to:

pause the mobile device advancing the substrate with the multi-ink image formed thereon at a position at which the one or more discrete pinned portions of the multi-ink image are aligned with the plurality of transparent portions of the filter component; and adjusting the frequency of the flashing of the light through the filter component to correspond to a timing of the pause of the mobile device advancing the substrate that aligns the one or more discrete-pinned portions of the multi-ink image with the plurality of transparent portions of the filter component.

17. The apparatus of claim 11, the plurality of transparent portions and the plurality of opaque portions of the filter component forming a pinning pattern, the pinning pattern being comprised on one of a dot matrix pattern or a crossing lines pattern.

18. The apparatus of claim 17, the filter component being formed of a transparent material with a non-transparent material being applied to the transparent material to form the plurality of opaque portions.

19. The apparatus of claim 17, the filter component being formed of a non-transparent material with holes punched therein to form the plurality of transparent portions.

20. The apparatus of claim 11, the multi-ink image being applied to the substrate using an ultraviolet gel thermal ink jetting printing process.

21. A non-transitory computer-readable storage medium storing instructions which, when executed a processor, cause the processor to execute a method for curing an image applied to a substrate, the method comprising:

applying a multi-ink image to a substrate with a print station;

curing one or more discrete portions of the multi-ink image on the substrate to a predetermined degree to form one or more discrete pinned portions of the multi-ink image on the substrate;

applying heat to the substrate with a heater element to cause non-pinned portions of the applied multi-ink image to reflow around the pinned portions to level the applied multi-ink image on the substrate between the pinned portions and the non-pinned portions; and separately curing the non-pinned portions of the applied multi-ink image.

* * * * *